United States Patent [19]

Preist

[11] 4,011,481

[45] Mar. 8, 1977

[54] MODULAR ELECTRON DISCHARGE DEVICE

[75] Inventor: Donald H. Preist, San Mateo, Calif.

[73] Assignee: Varian Associates, Palo Alto, Calif.

[22] Filed: Oct. 28, 1975

[21] Appl. No.: 625,962

[52] U.S. Cl. ..... 313/302; 313/237; 313/267; 313/304

[51] Int. Cl.[2] ..... H01J 1/46; H01J 21/10

[58] Field of Search ..... 313/302, 304, 237, 267, 313/278, 293, 348

[56] References Cited

UNITED STATES PATENTS

| | | | |
|---|---|---|---|
| 2,512,618 | 6/1950 | Edwards et al. | 313/278 X |
| 2,512,620 | 6/1950 | Edwards | 313/278 X |
| 2,853,640 | 9/1958 | Hoover | 313/304 X |
| 3,506,871 | 4/1970 | Hunt | 313/278 |
| 3,544,831 | 12/1970 | Hammersand et al. | 313/293 |
| 3,562,576 | 2/1971 | Rusterholz | 313/304 |
| 3,863,163 | 1/1975 | Farrell et al. | 313/302 |

*Primary Examiner*—Saxfield Chatmon, Jr.
*Attorney, Agent, or Firm*—Stanley Z. Cole; Richard B. Nelson; Robert K. Stoddard

[57] ABSTRACT

A grid-controlled electron tube is constructed with a common anode and an array of individual cathode-grid modules. The simple modules can be built with greater accuracy than large, complex electrodes. The modules can be individually tested before final assembly, and can be individually replaced in case of a failure during construction or later operation. In a preferred embodiment, the cathode is a cylindrical filament surrounded by a coaxial grid, each grid turn being mounted to a common support on the side opposite the anode. In a tetrode embodiment, additional focusing bars at the sides of the grid direct electrons into beams which pass between large screen-grid wires.

12 Claims, 8 Drawing Figures

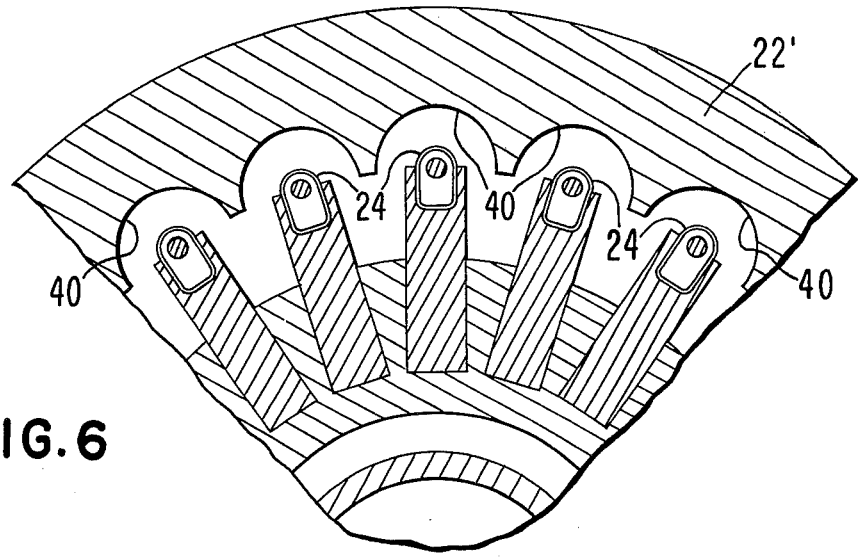
FIG. 6
FIG. 7
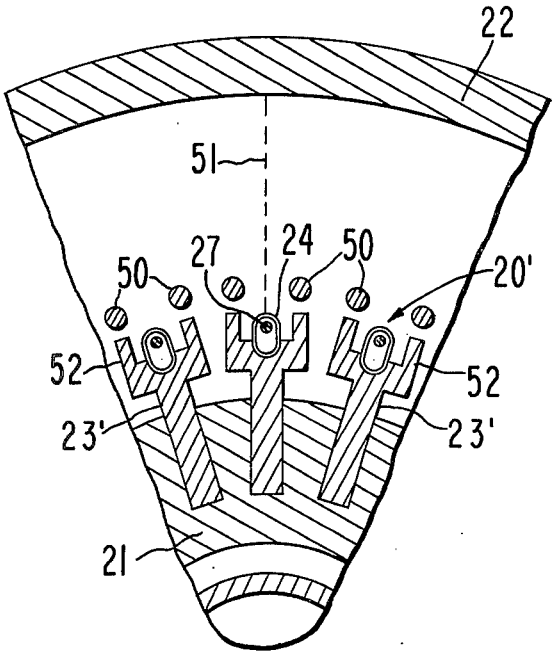
FIG. 8
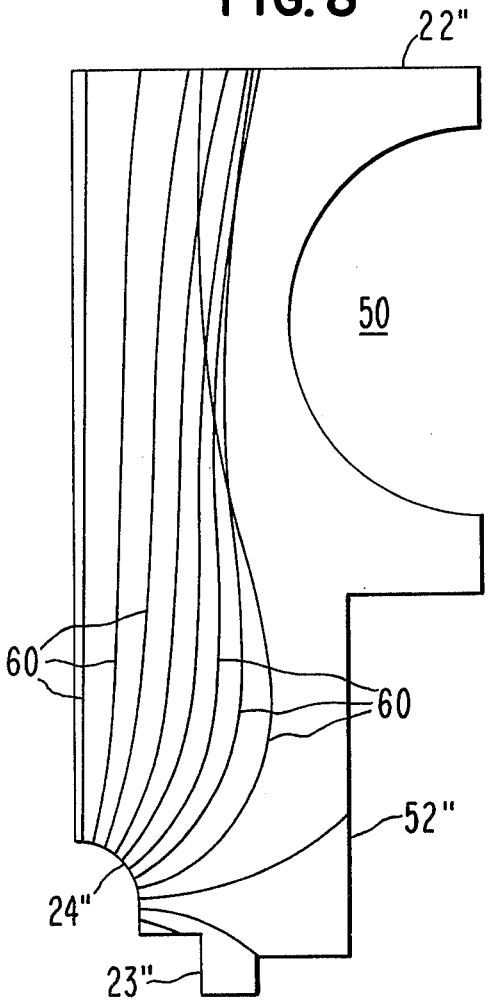

MODULAR ELECTRON DISCHARGE DEVICE

FIELD OF THE INVENTION

The invention relates to high power grid-controlled electron tubes such as triodes and tetrodes. To achieve high power output with low grid drive, the electrodes must be large but nevertheless closely spaced. When used as a switch to control high voltage dc, the amplification factor should be high, requiring a fine-mesh close-spaced grid.

PRIOR ART

Tubes intended to control high anode currents and voltages by relatively low grid drive voltages have usually relied on making the cathode and grid electrodes as wire mesh or squirrel-cage structures. When these structures get large in area, as required for high current capacity, the mechanical problems of controlling the physical dimensions and maintaining them through the operational temperature cycling, become severe.

An attempt to provide a rugged, dimensionally stable structure involved disposing an array of individual cathode filaments in individual slots in the surface of a massive copper cylinder, each filament being individually positioned and tensioned by spring supports. A fine wire grid was wound around the outer surface of the cylinder, crossing the mouths of the cathode slots. While these tubes did handle very high power with reasonably low grid drive, they proved to have serious defects. The cost of construction was very high because the vast number of assembly operations had to be done sequentially by hand, and a failure in any one of the cathode-grid unit cells could require scrapping the whole assembly. An example of these tubes is described more fully below. Similar tubes are described by M. V. Hoover in the Proceedings of the Institution of Electrical Engineers, Vol. 105, Part B, Supplements 10–12, pages 550 et. seq., Paper No. 2752R, Nov. 1958.

U.S. Pat. No. 2,186,127 issued Jan. 9, 1940, to A. L. Samuel describes a tube with a cylindrical sector cathode and grid subassembly. This tube has the problems described above, that to handle high power the structure would be complex, expensive and unreliable.

SUMMARY OF THE INVENTION

An objective of the invention is to provide a grid-controlled electron tube in which high current at high voltage can be controlled by a low grid voltage.

A further objective is to provide a large tube which can be cheaply manufactured.

A further objective is to provide a large tube in which small electrode spacings can be accurately controlled.

A further objective is to provide a tube which can easily be repaired.

A further objective is to provide a tetrode with rugged screen grid elements which intercept a minimum electron current.

These objectives are achieved in the present invention by a novel modular construction in which a cathode element and an associated control grid element are mounted on a common support member to form an electron source module. The simple modules can be accurately and cheaply manufactured by mass-production methods. A plurality of these source modules are then connected and mounted together in an array to form an extended cathode-grid structure which retains the electrode spacing accuracy of the individual modules and supplies electron current to a common anode.

Well adapted for use with the modular construction is a novel arrangement of cathode and grid in which the cathode is a right circular cylinder, such as a simple wire, and the grid has a cylindrical shape, at least a part of the grid cylinder having constant spacing from at least a part of the cathode. The turns of grid wire are joined to a common support at points opposite the side facing the anode.

In other embodiments the cathode may have a flat or concave emitting surface and the grid a conforming shape.

A tetrode embodiment has focusing bars at the sides of the grid elements operating at grid or cathode potential. These bars deflect the electrons into a flat beam from each module. Massive screen grid bars between the focusing bars and the anode thus intercept very few electrons.

In the prior art, interception of electrons by the screen grids of tetrodes has been minimized by making the grids of fine wires and aligning them with the control grid wires. When the two grids are operated at different potentials, they form electron lenses which focus the electrons emanating from the cathode and cause most of them to reach the anode. The fine wire screen grid also acted as an effective electrostatic shield between the anode and the control grid, bringing about a relative independence of anode current on anode potential, one of the advantages of a tetrode over a triode.

In the present invention, the mechanisms of focussing, shielding, and control of anode current are substantially independent of each other. The focussing of electrons from the cathode into a beam is produced mainly by the focussing electrodes.

The beam current amplitude is controlled by the grid potential but the focussing is largely independent of grid potential. The electrostatic shielding effect of the screen is obtained without the use of fine wires closely spaced. Instead, bars of relatively large cross section are arranged so that the gaps between them are no greater than their thickness measured in the direction of electron flow to the anode.

BRIEF DESCRIPTION OF THE DRAWINGS

FIG. 6 is a partial sectional plan view of a different triode embodiment.

FIG. 7 is a partial sectional plan view of a tetrode embodiment.

FIG. 8 is a plot of electron trajectories in the tetrode of FIG. 7.

DESCRIPTION OF THE PREFERRED EMBODIMENTS

Figure 1:
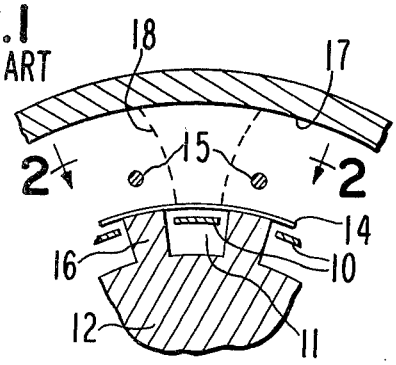
FIG.1 PRIOR ART
FIG. 1 is a partial sectional plan view of a prior art tetrode structure incorporating individually mounted cathode elements.
Figure 2:
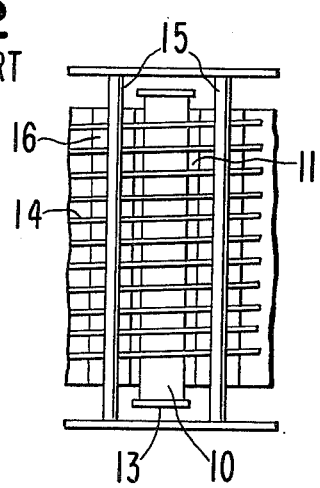
FIG.2 PRIOR ART
FIG. 2 is an inward looking sectional elevation of the tube of FIG. 1 taken on line 2—2.

FIGS. 1 and 2 illustrate one of the more sophisticated prior-art grid-controlled electron tubes, designed for high power operation at VHF frequencies. A cylindrical array of thermionic cathodes 10, in the shape of flat ribbon filaments, are disposed in slots 11 in a generally cylindrical copper support member 12. Filaments 10 are supported at their free ends by tension springs 13. A control grid of fine wires 14 is wound around support cylinder 12, bridging the open ends of slots 11 and spaced from cathodes 10. Spaced from control grid 14 are massive screen grid bars 15, located opposite the ridges 16 on support cylinder 12 between grooves 11. A surrounding anode 17 collects the electron streams 18 drawn from cathode 10.

This prior art tube allowed individual setting of the cathode positions and provided a high amplification factor by virtue of a close-spaced control grid 14 of fine wires. This tube was, however, very expensive to construct because the grid structure was large and complex and the numerous filaments 10 had to be mounted and adjusted one at a time on the support cylinder. The grid wires 14 were essentially straight sections, so when a wire overheated in operation it would buckle. In operation, a failure of any one filament 10 would often disable the entire tube. If the accompanying section of grid was ruined, the whole structure was then nonrepairable.

Figure 3:
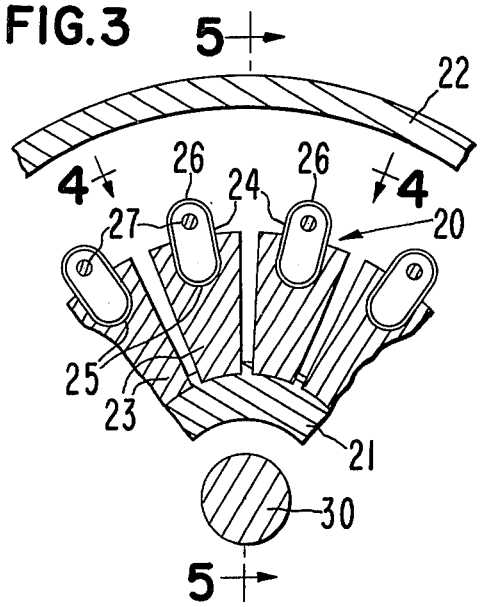
FIG. 3 is a partial sectional plan view of a triode embodiment of the present invention.
Figure 4:
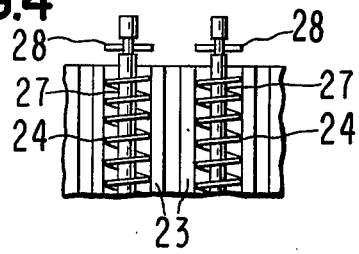
FIG. 4 is an inward looking elevation of the tube of FIG. 3 taken along line 4—4.
Figure 5:
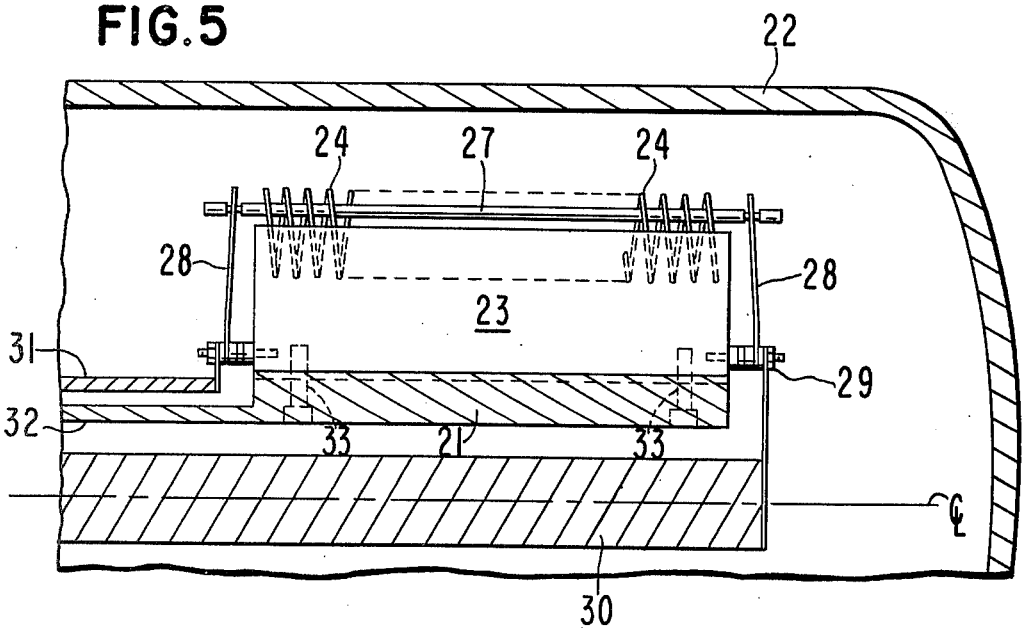
FIG. 5 is an axial section of the tube of FIG. 3, taken along line 5—5.

FIGS. 3, 4 and 5 show a portion of an improved tube structure according to the present invention. The embodiment illustrated is a triode, suitable as a switch for high voltage, high current dc or as a high power rf amplifier. The inventive modular electron source can, of course, have applications in other types of electron discharge devices such as electron-beam excited gas lasers, etc. p In the triode of FIGS. 3, 4 and 5, a plurality of grid-cathode electron source modules 20 are mounted as by bolting on a common support 21, such as a generally cylindrical copper post which may be water cooled. Electrons from the array of source modules 20 are drawn to a common anode 22, which may be a copper shell forming part of the tube's vacuum envelope. Alternatively, the tube electrodes may be inverted, with the anode inside a generally cylindrical cathode grid array of modules, or in some cases a planar array may be used.

Source module 20 comprises a massive support member 23 on which is mounted a fine wire grid 24 having the general shape of an elongated cylinder of oval cross-section. Grid 24 is a wound helix of fine wire such as tungsten. The back part 25 of each turn is affixed, as by brazing, to support member 23. The front part 26 of grid 24 facing anode 22 has a semi-circular cross section. Concentric with it is the cathode filament 27 which is an elongated right circular cylinder as of thoriated tungsten. Due to the closer spacing, most of the emission is drawn from the front half of cathode 27. The emission current is thus readily drawn to the anode.

Filament 27 is supported at its ends protruding beyond grid 24 by flat metallic ribbon springs 28 as of molybdenum mounted on support member 23 by insulating studs 29. Ribbons 28 carry filament heating current and are connected via studs 29 to common coaxial heater supply leads 30 and 31. Common support block 21 is likewise mounted on a coaxial lead 32. Leads 30, 31 and 32 and anode 22 are mounted on conventional coaxial dielectric seals (not shown) to complete the vacuum envelope and support the electrodes in insulated, spaced relationship. The coaxial leads and block 21 may be cooled by circulating water channels (not shown).

In manufacturing the tube of FIGS. 3, 4 and 5, the grid-cathode modules 20 may be made on a production line basis. They are identical parts suitable for mass production, and the same modules may be used, in differing numbers, to make a variety of tubes of different power levels. Each module 20 is assembled as a unit and may be individually tested before being committed to a tube. In final assembly, module support members 23 may be brazed to support mount 21 or may be individually attached by bolts 33 to facilitate repairs.

FIG. 6 shows a slightly different embodiment of the invention. Anode 22' is formed with an array of cylindrical flutes 40 partially surrounding grid elements 24. The effective grid-anode spacing is substantially uniform, making the current density and also the power dissipation density on anode 22' more nearly uniform. Also, the uniform spacing provides equal electron transit times between grid and anode, improving operation at very high frequencies.

FIG. 7 illustrates an embodiment of the invention in a tetrode. The screen grid is an array of cylindrical bars 50 parallel to cathodes 27. Bars 50 are spaced aside from the direct paths 51 from cathodes 27 to anode 22 to reduce emission current interception. Also, each current source module 20' has a beam focusing bar 52 spaced at each side of grid 24. Bars 52 are in this example made integral with module support members 23'. The bars may alternatively be separate electrodes which can be operated at cathode potential.

FIG. 8 illustrates the action of focus bars 52. The figure is a two dimensional plot of computer-calculated electron trajectories 60 in a section of a tetrode similar to that of FIG. 7. The trajectories 60 are launched radially from grid 24''. The diverging trajectories 60 are refocused by the anode and screen fields penetrating between bars 52'' to form a beam passing between screen grid bars 50 to anode 22''. With this excellent focusing, screen bars 50 can be of large diameter, which is advantageous for high voltage operation because the electric field strength at the surface of bars 50 is reduced, reducing the danger of high vacuum arcs.

The above described embodiments are illustrative of features of the invention, and are not intended to be limiting. Many other embodiments will be obvious to those skilled in the art. Several cathode-grid sets may be mounted on each support member. Other geometrical arrangements of the arrays of electron source modules, such as planar, sectoral or inverted cylindrical, may be used. The cathode may be other shapes than a right circular cylinder, such as a half cylinder, etc. The invention is intended to be limited only by the following claims and their legal equivalents.

What is claimed is:

1. A grid controlled electron discharge device comprising an anode and a plurality of electron source modules, each module comprising, an elongated support member, an electron emissive cathode in the form of an elongated cylinder, mechanically mounted on said support member, and an electron permeable grid mechanically mounted on said support member, at least a portion of said grid positioned between said cathode and said anode, at least one of said cathode and said grid being electrically insulated from said support member, said source modules being mounted with said cylindrical cathodes parallel and spaced apart in a direction perpendicular to said cylinders.

2. The device of claim 1 further including cathode supports near both ends of said cylinder.

3. The device of claim 2 wherein said supports are adapted to carry current for heating said cathode and wherein at least one of said supports is deformable in the direction of the axis of said cylinder.

4. The device of claim 3 wherein said one of said supports includes a spring for keeping said cathode in tension.

5. The device of claim 1 wherein said grid comprises an array of fine wires.

6. The device of claim 5 wherein at least a portion of said wires are uniformly spaced from at least a portion of the surface of said cathode.

7. The device of claim 5 wherein said wires are spaced in the direction of the axis of said cylinder and wherein each of said wires is joined to said support member.

8. The device of claim 7 wherein said wires encircle said cylinder and are connected to said support at points removed from the side of said cathode facing said anode.

9. The device of claim 1 wherein at least a portion of the surface of said cathode is a right circular cylinder.

10. The device of claim 9 wherein at least a portion of said wires lie on a right circular cylinder coaxial with said cathode.

11. The device of claim 1 further comprising focusing bars parallel to said axis and spaced from said grid to the sides of the direct path from said cathode to said anode, said focusing bars being adapted to operate at a potential near that of said cathode and said grid.

12. The device of claim 11 further comprising screen grid bars parallel to said axis spaced between said focusing bars and said anode.

* * * * *